US007032627B1

(12) United States Patent
Sheriff

(10) Patent No.: US 7,032,627 B1
(45) Date of Patent: Apr. 25, 2006

(54) WIRE FORMING TOOL

(75) Inventor: Timothy W. Sheriff, Duluth, MN (US)

(73) Assignee: Swanstrom Tools USA, Inc., Superior, WI (US)

( * ) Notice: Subject to any disclaimer, the term of this patent is extended or adjusted under 35 U.S.C. 154(b) by 238 days.

(21) Appl. No.: 10/664,108

(22) Filed: Sep. 17, 2003

(51) Int. Cl.
*B21F 3/00* (2006.01)
*B21F 1/06* (2006.01)

(52) U.S. Cl. ..... 140/102.5; 140/104

(58) Field of Classification Search ..... 140/102.5, 140/104, 106
See application file for complete search history.

(56) References Cited

U.S. PATENT DOCUMENTS 649,955 A * 5/1900 Ronk ..... 7/134
2,824,583 A * 2/1958 Knoester ..... 140/104
3,861,430 A * 1/1975 Story ..... 140/106
4,043,364 A 8/1977 Rose
4,423,757 A * 1/1984 Broberg, Jr. ..... 140/123
4,637,084 A * 1/1987 Wood ..... 7/134
5,520,227 A * 5/1996 Kelley ..... 140/102.5

* cited by examiner

*Primary Examiner*—Derris H. Banks
*Assistant Examiner*—Debra Wolfe
(74) *Attorney, Agent, or Firm*—Faegre & Benson LLP

(57) ABSTRACT

A wire forming pliers having opposed faces on jaws, each with a relief between the face and a pivot point of the pliers, the reliefs forming a recess, and a link loosely secured to the pivot point and carrying a post extending into the recess such that a loop can be formed in a U-shaped wire received in the recess around the post by closing the jaws until the faces compress the U-shape into a loop around the post.

12 Claims, 16 Drawing Sheets

WIRE FORMING TOOL

BACKGROUND OF THE INVENTION

The present invention relates to the field of hand tools for forming wire and the like, more particularly, to pliers for forming wire into loops and similar shapes.

In the past, wire loops have been formed using conventional longnose pliers, resulting in imperfect loops. Round nose pliers have permitted formation of more circular loops, but did not assure that repeated use would result in identical sized loops, because of the tapered jaws of the pliers.

Other specialty pliers are known for forming wires into loops, commonly known as wire wrapping pliers, which have one jaw formed in a series of stepped diameter cylinders, and the other jaw being flat or concave where it faces the cylindrical jaw. Such wire wrapping pliers were not convenient to forming tight loops because the wire was gripped between the jaws at a location which was typically 180 degrees away from the closure of the loop. Forming the loop adjacent the contact between the jaws of such pliers exposes the wire to the edge of the flat or concave jaw, reintroducing the possibility of undesired deformation of the wire resulting from contact with such edge.

The present invention overcomes the shortcomings of the prior art by providing a pliers-type wire forming tool that is easy and convenient to use to form consistently-sized wire loops, with or without a coil adjacent the loop.

BRIEF SUMMARY OF THE INVENTION

In one aspect, the present invention includes a tool for forming wire, with a first member and a second member, each having a jaw and a handle and a mediate region between the jaw and handle; and a connecting means for securing the first and second members together at the mediate regions thereof and for permitting pivoting movement between the first and second members while locating the jaws on the same side of the connecting means such that the jaws are opposed to each other and free to move towards and away from each other; and a link attached to the mediate regions of the first and second members, and extending on the same side of the connecting means as the jaws, the link having a post projecting from the link and extending intermediate the jaws for forming wire around the post.

In another aspect the present invention includes a method of forming a loop in wire having the steps of forming a U-shape in a wire; placing the U-shape between a pair of jaws in a pliers of the type having opposing faces on respective distal ends of a pair of jaws, with each jaw having a relief between the face and a pivot point of the pliers, the reliefs forming a recess, such that the U-shape extends around a post located in the recess; closing the jaws against the wire such that the faces compress the U-shape into a loop surrounding the post; and removing the wire loop from the pliers.

DETAILED DESCRIPTION OF THE INVENTION

Figure 1:
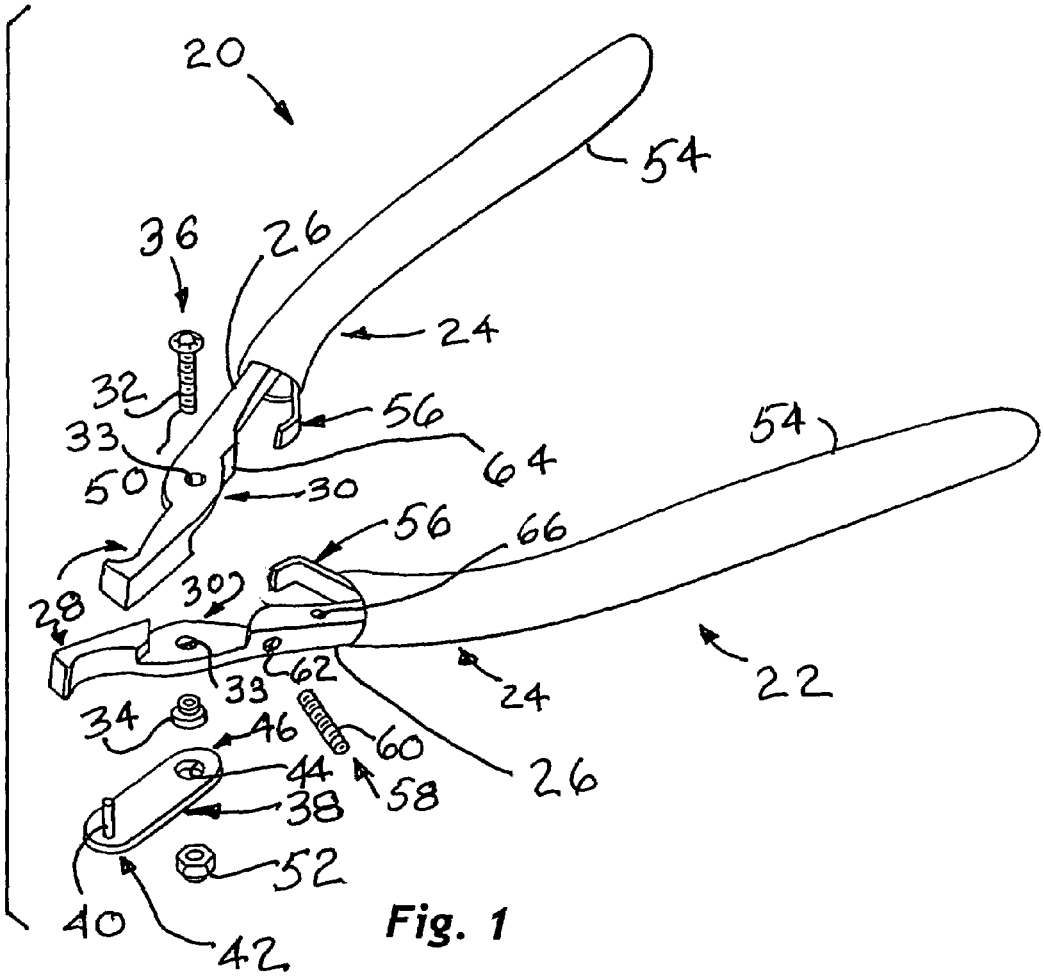
FIG. 1 is an exploded view from above of the parts of the pliers of the present invention.
Figure 2:
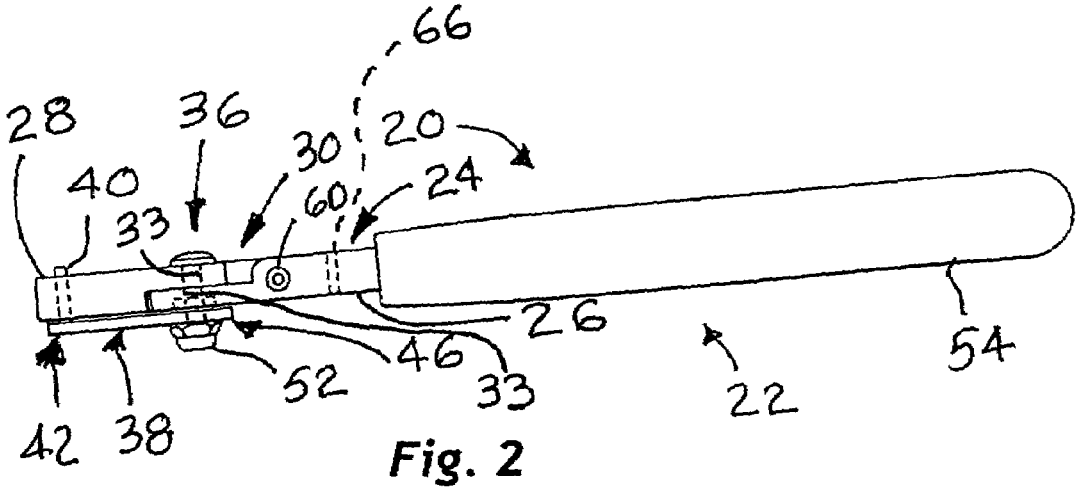
FIG. 2 is an elevational side view of an assembled pliers of the present invention.
Figure 3:
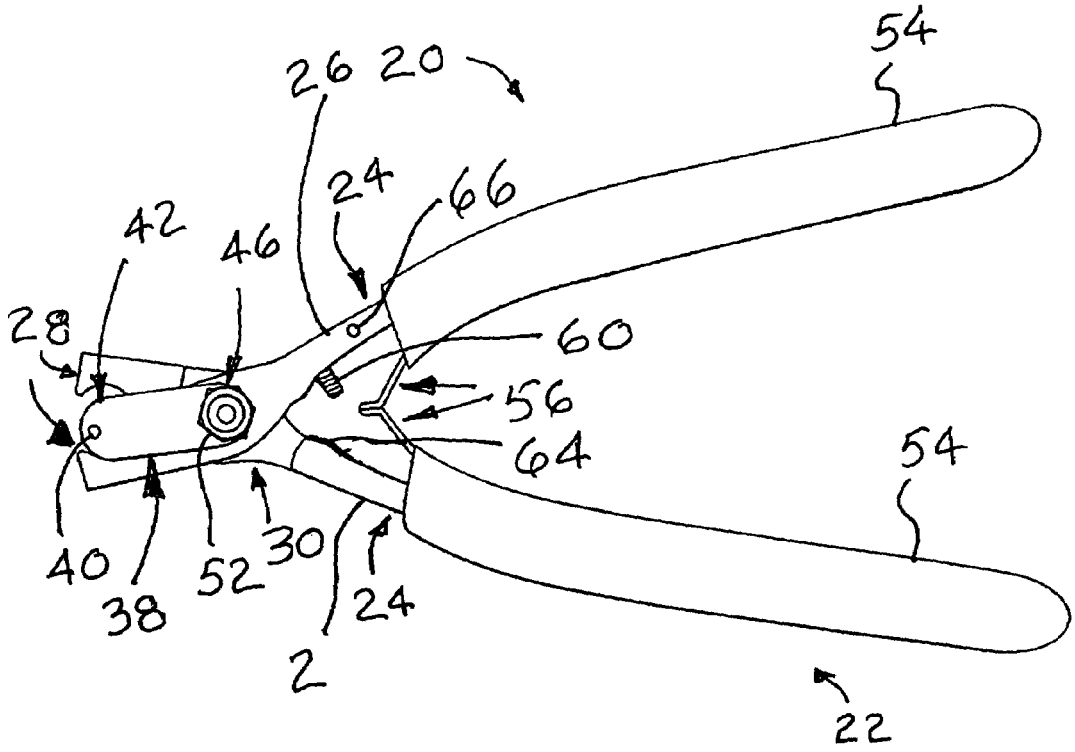
FIG. 3 is bottom plan view of the pliers of FIG. 2.

Referring now to the Figures, and most particularly, to FIGS. 1, 2 and 3, a hand tool 20, generally in the form of a pair of pliers 22 may be seen. Pliers 22 are preferably formed with two nearly identical members 24, each of which have a handle 26 and a jaw 28 connected by a mediate portion 30.

The pliers 22 have members 24 joined at the mediate portions or regions 30 for pivoting movement between members 24. One or both of a screw 32 and rivet 34 form a pivot or connecting means 36 for securing members 24 together for pivoting movement therebetween. Alternatively, other forms of pivoting securement may be used while still staying within the scope of the present invention. The connecting means 36 secures members 24 (which may be referred to as "first and second members") together at the mediate portions or regions 30 thereof, while at the same time permitting pivoting movement between the first and second members while locating the jaws 28 on the same (distal) side of the connecting means 36 such that the jaws 28 are opposed to each other and free to move towards and away from each other. The connecting means 36 is thus understood to include the screw 32 received in one of the first and second members, and (preferably) further includes the threaded rivet received in the other of the first and second members with the screw 32 extending through a pair of aligned apertures 33 in the first and second members 24.

Figure 17:
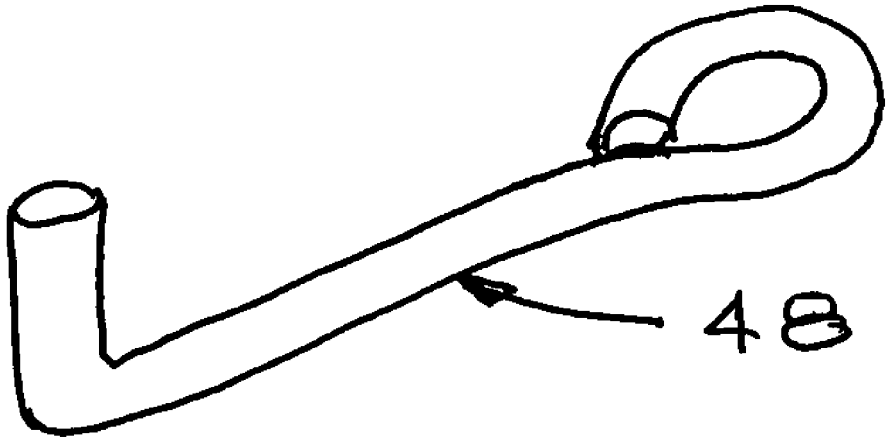
FIG. 17 is a still further alternative embodiment for the post and link of the present invention.

A link 38 is preferably also secured to the pliers 22 by the pivot 36, and preferably, the link 38 is free to move within a limited range of movement as will be described infra. Link 38 has a post 40 projecting from a first end 42 thereof, and an aperture 44 at a second end 46 thereof. Alternatively, the link and post may be formed of a single piece of wire 48, as shown in FIG. 17. The link 38 is attached to the mediate region 30 of at least one of the first and second members 24 and extends on the same (distal) side of the connecting means 36 as the jaws 28. The post 40 projecting from the link 38 extends intermediate the jaws 28 for forming wire around the post 40, in a manner to be described infra.

It is to be understood that the pivot 36 preferably has a projection, such as additional threads 50 extending laterally from the mediate region 30 beyond the rivet 34 by an amount sufficient to retain the link 38 using, for example, a threaded fastener such as a locking nut 52 received on threads 50 to loosely hold link 38 to the pliers 22.

Optionally, each handle 26 may have a resilient cover 54 and pliers 22 may have a pair of opening springs 56, although neither is necessary for the present invention. Pliers 22 preferably also has a stop 58 to limit the approach of the jaws 28 together. Stop 58 is preferably formed by an Allen screw 60 received in a threaded bore 62 in one member 24 and an anvil surface 64 on the other member 24. As may be seen most clearly in FIG. 8, stop 58 provides an adjustable limit for the distance between the jaws when the handles 26 are grasped, closing the pliers 22. Such a limit is desirable to avoid marking or deforming wire being formed in the pliers. The stop 58, preferably made up of Allen screw 60 and anvil surface 64, limits the amount of pivoting movement of the jaws 28 toward each other.

Figure 4:
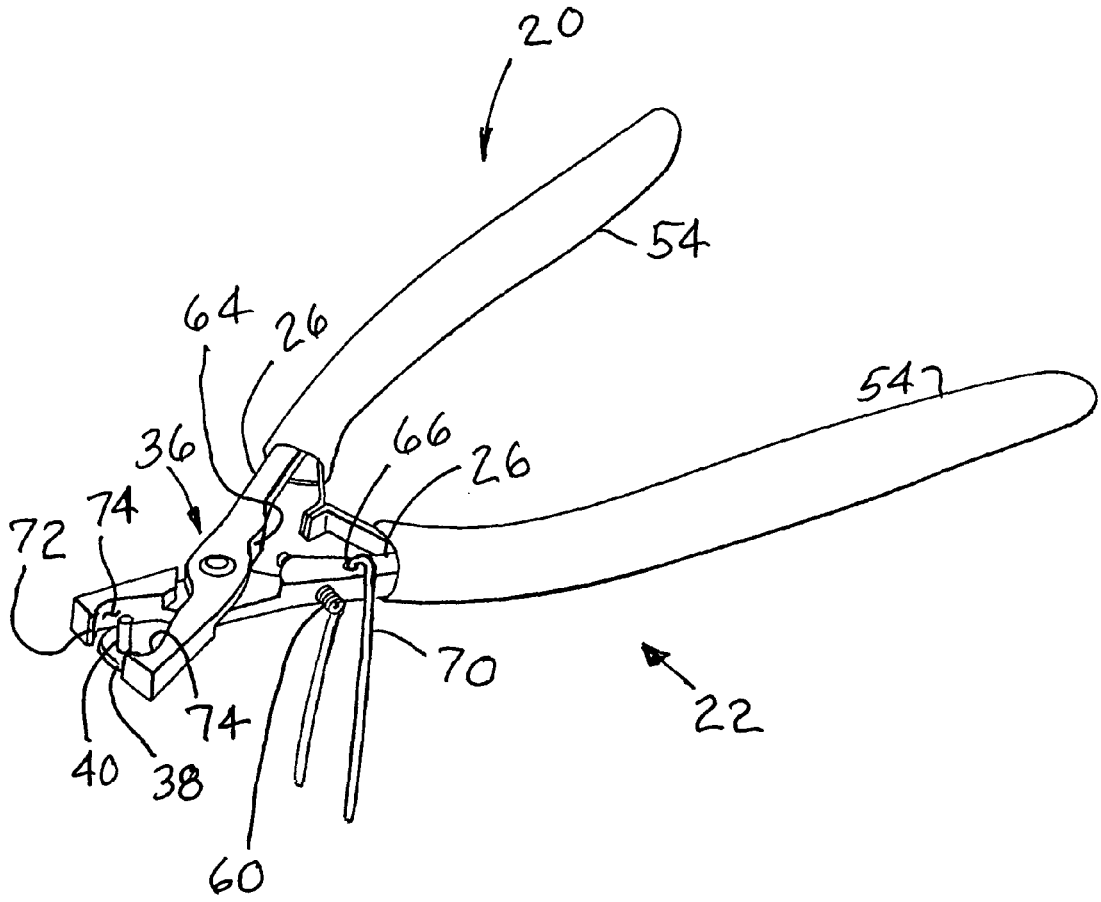
FIG. 4 is a perspective view of the pliers of FIG. 2, showing a wire bending feature forming a wire into a U-shape, preparatory to forming a loop in the wire.

Referring now also to FIG. 4, a smooth through-hole or bore 66 may be provided in one handle 26 to enable initial bending of a wire workpiece 70. The through hole 66 can be located in one (or even both) of the first and second members 24 for receiving the wire 70 to make a prebend therein.

Figure 5:
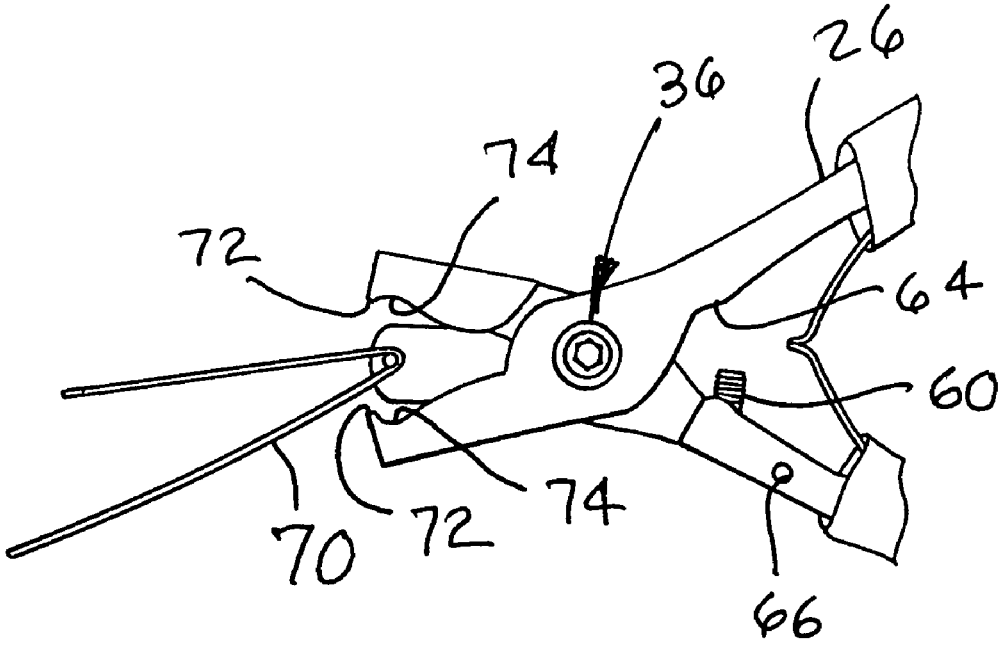
FIG. 5 is a fragmentary top plan view showing the U-shape of the wire received within the jaws and over a post in a recess of the jaws of the pliers of FIG. 2.
Figure 6:
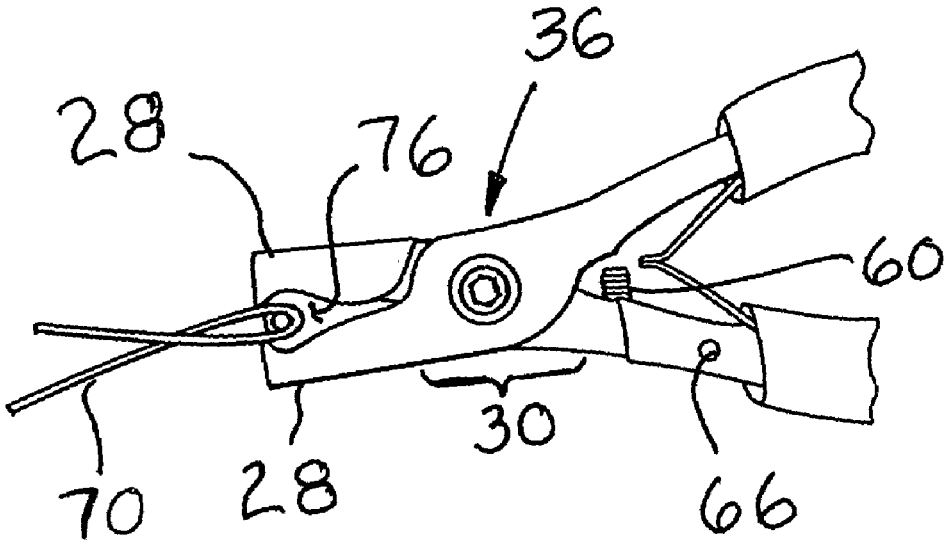
FIG. 6 is a view similar to that of FIG. 5, except with the jaws partially closed.

As may be seen most clearly in FIGS. 4 and 5, the jaws 28 each have a face 72 at a distal end thereof, and a relief 74 intermediate the face and the mediate region 30. When the first and second members are assembled with the faces 72 opposing each other, the reliefs 74 form a recess 76. The post 40 projects into recess 74, as may be seen clearly in FIG. 6, where the jaws 28 are partially closed toward each other. As shown in the Figures, faces 72 are flat; however, it is to be understood that one or both faces 72 may have other configurations while still remaining within the scope of the present invention. For example, and not by way of limitation, one or both faces may have a convex configuration with a smooth transition to the respective relief on that jaw to aid in making a smooth transition in the wire workpiece between the portion of the wire looped around the post and the portion(s) of the wire adjacent the faces of the jaws. It is to be understood, however, that the wire forming occurs primarily as a result of the post, and secondarily, as a result of the jaws. This is in contrast to specialty pliers in which the jaws alone are used to form a workpiece.

Figure 7:
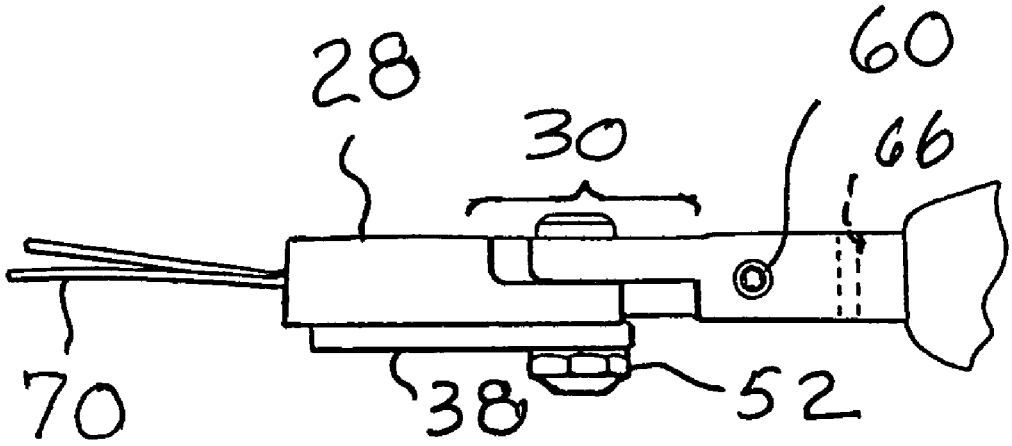
FIG. 7 is fragmentary elevational side view corresponding to that of FIG. 2, except showing a wire captured in the jaws of the pliers.
Figure 8:
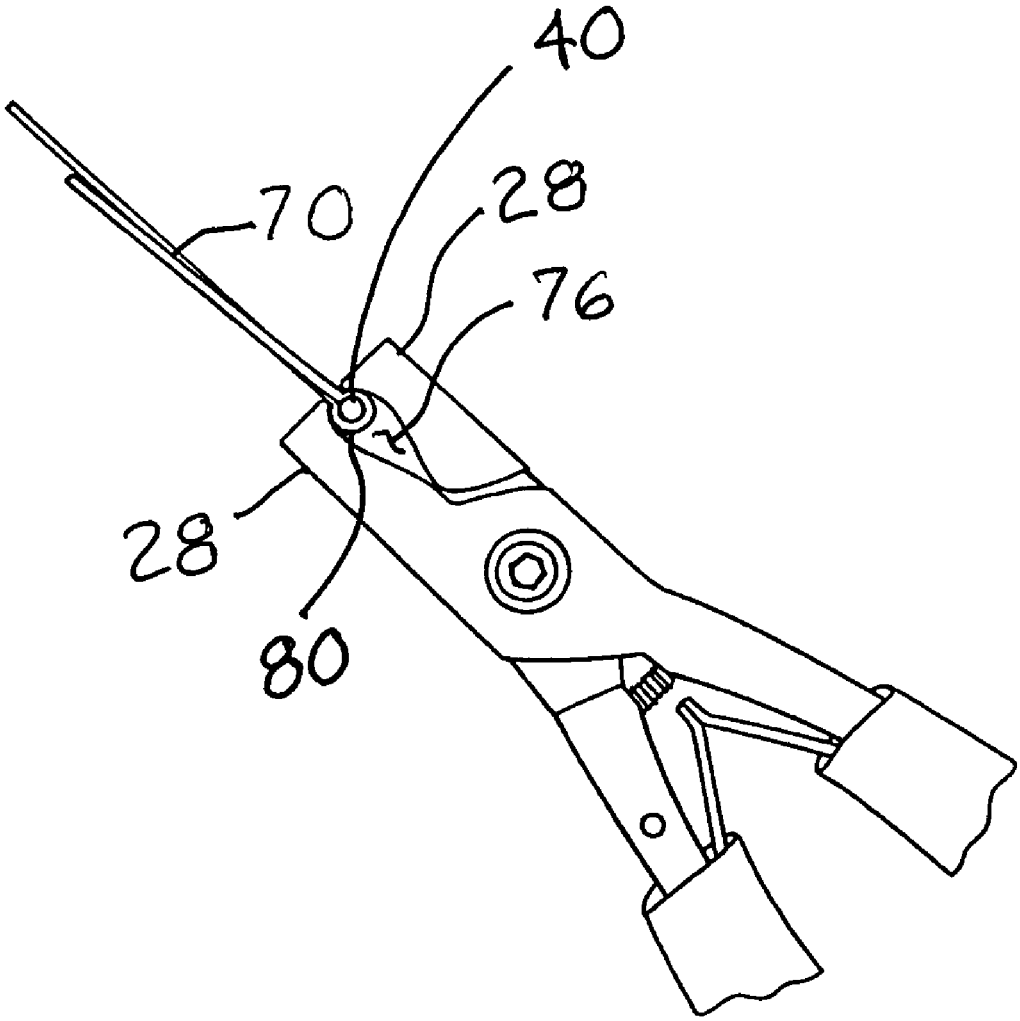
FIG. 8 is a view similar to that of FIG. 5, except with the jaws fully closed against the wire, forming the loop.
Figure 9:
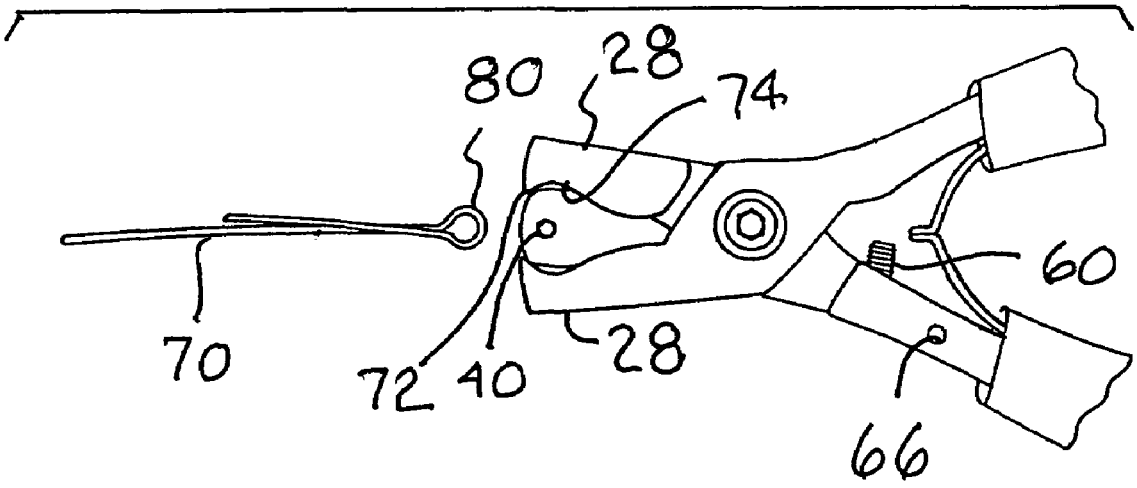
FIG. 9 is a fragmentary view similar to that of FIG. 4, except after the wire has been formed into a loop and removed from the pliers.
Figure 10:
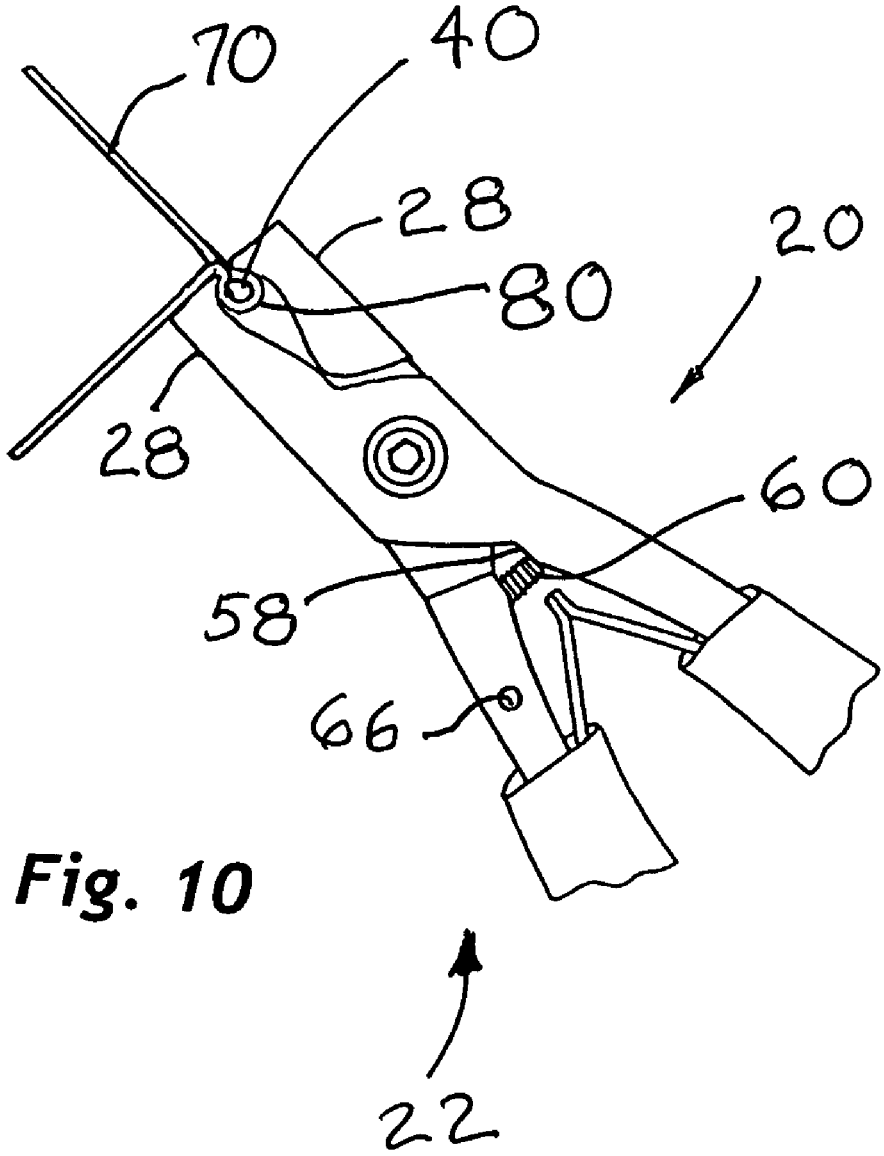
FIG. 10 is a view similar to that of FIG. 8, except with a portion of the wire deformed after formation of the loop.
Figure 11:
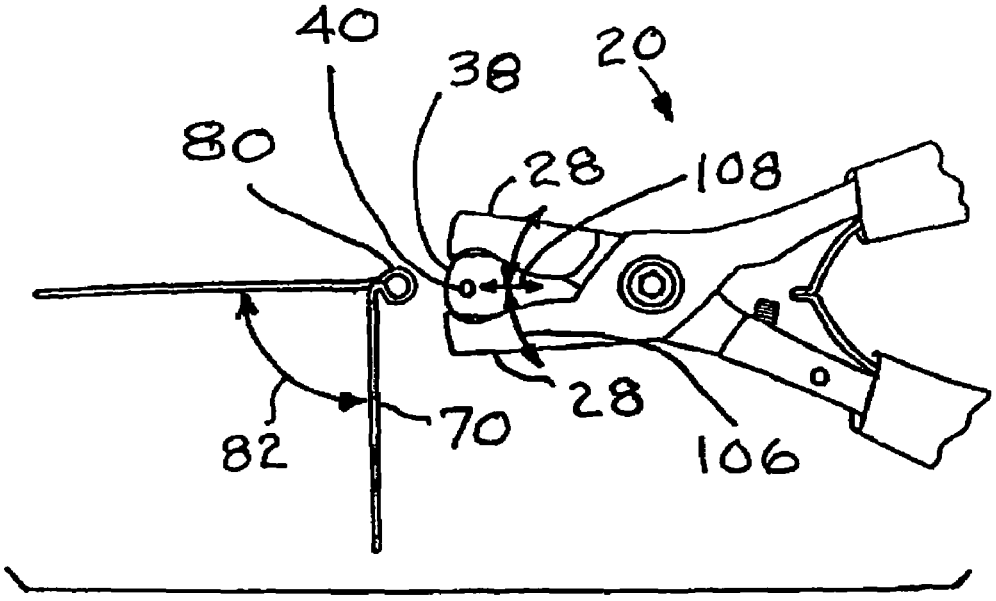
FIG. 11 is a view similar to that of FIG. 10, except with the wire removed from the pliers.
Figure 12:
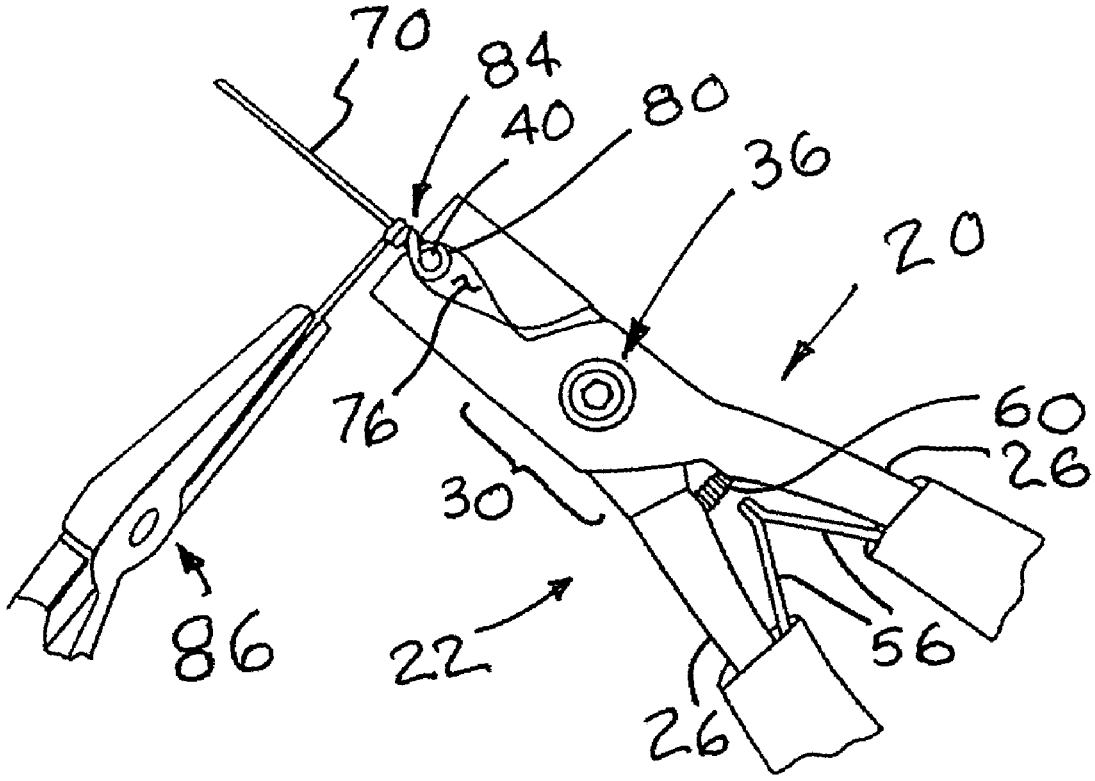
FIG. 12 is a view similar to that of FIG. 10, except showing formation of a coil adjacent the loop.
Figure 13:
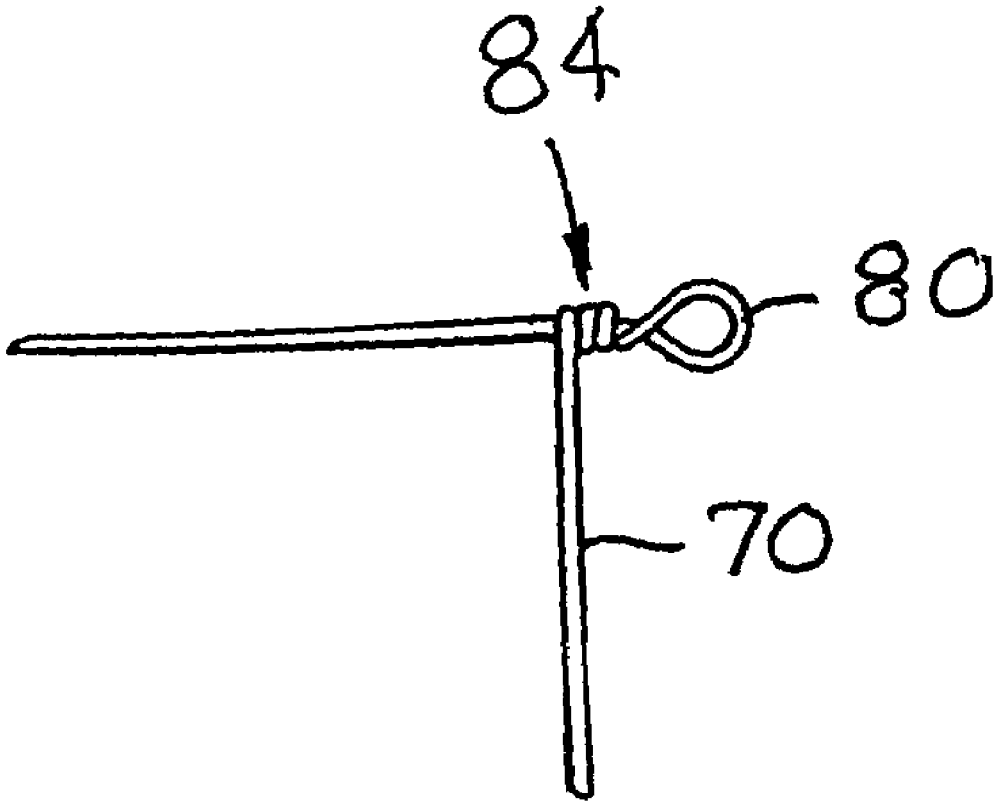
FIG. 13 is a view of the wire after formation of the loop and adjacent coil.

Referring now to FIG. 7, wire 70 is preferably held generally laterally centered within jaws 28. As the jaws 28 are closed against each other, as shown in FIG. 8, a loop 80 is formed in wire 70, which may also be seen separately in FIG. 9 after the jaws 28 are opened, and the wire is removed laterally from post 40 and out from recess 76. Alternatively, instead of removing the wire 70 from the tool 20 as shown in FIG. 9, the wire 70 may be held in tool 20 and further formed, as shown in FIGS. 10 and 12. FIG. 11 shows an intermediate stage in which the wire 70 is formed with the loop 80 and a right angle 82. FIG. 12 shows the process of forming the wire 70 to have a number of wraps 84 of one portion of the wire around another portion of the wire 70 to support the loop 80. A second tool, such as a longnose or duckbill pliers 86 may by used to assist in the formation of the wraps 84. Once the loop 80 and wraps 84 are formed in the wire 70, the wire workpiece will appear as it does in FIG. 13. At this time, the wire 70 may be further formed, or the tail 88 extending from the wraps 84 may be severed from the remainder of the wire workpiece, using conventional tools and processes.

Figure 14:
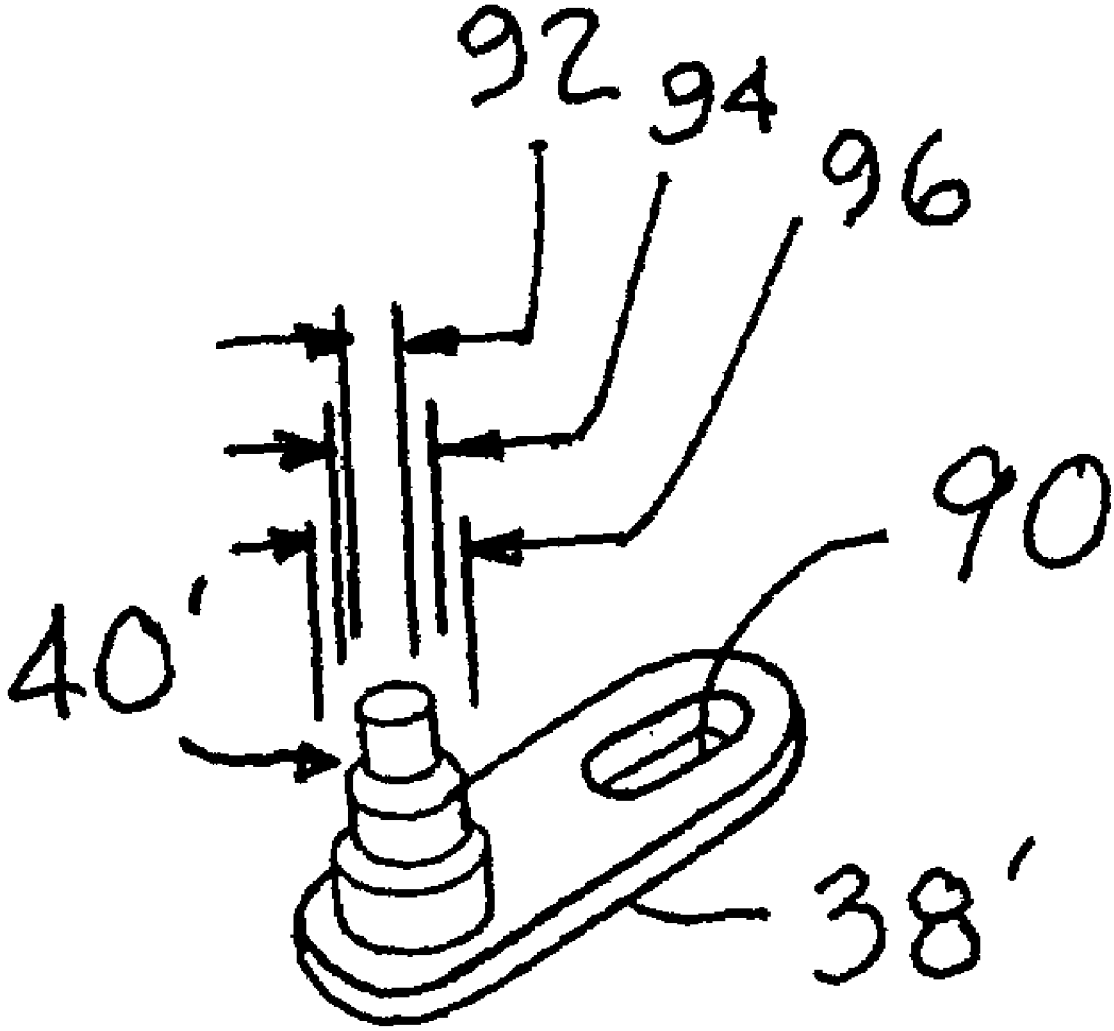
FIG. 14 is an alternative embodiment for the post and link useful in the practice of the present invention.

Referring now to FIG. 14, an alternative embodiment for the link 38' and post 40' may be seen. Link 38' has a slot 90 for aperture 44, instead of a circular hole, as illustrated in FIG. 1. Post 40' has a stepped configuration with a plurality of diameters 92, 94, 96 on which to form the loop 80. Although three diameters are shown, it is to be understood that more or fewer diameters may be used in the practice of the present invention. Furthermore, it is to be understood that the aperture shape and number of diameters for post 40 are independent of each other and may be utilized as such.

Figure 16:
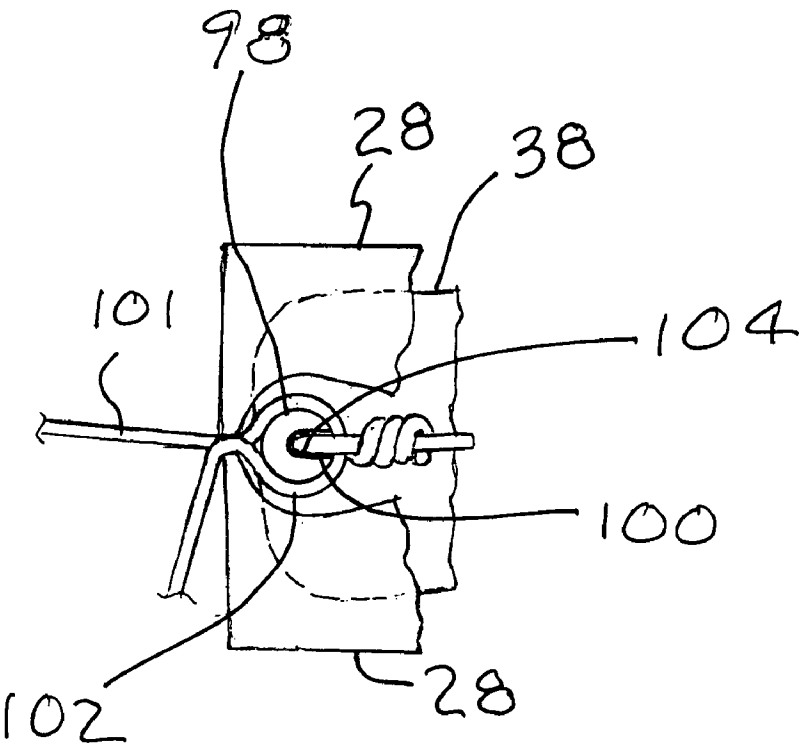
FIG. 16 is a top plan view of the parts shown in FIG. 15 in a second position.
Figure 15:
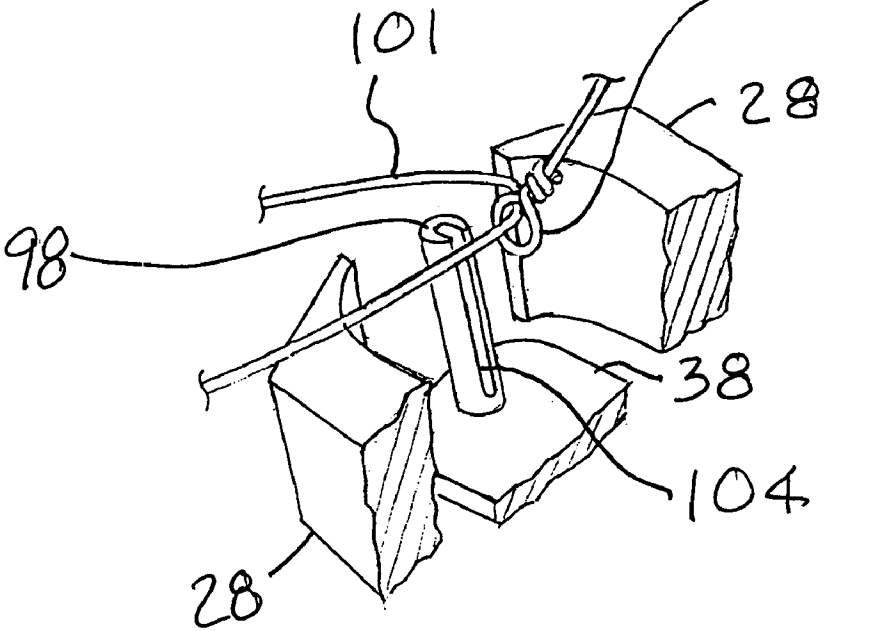
FIG. 15 is an enlarged fragmentary perspective view of the jaws with an alternative embodiment of the post and link in a first position for forming interengaging loops.

Referring now to FIGS. 15 and 16, a still further variation for post 40 may be seen. In this embodiment, a slotted post 98 may be used to form interengaging loops 100, 102. Loop 100 is formed in the same manner as loop 80, after which loop 100 is received over a U-shaped portion of wire 101, and the loop 100 is then received in a slot 104 in post 98 as loop 102 is formed in the same manner as loop 80 and 100. Slot 104 is sized to receive loop 100 and to permit formation of loop 102 without deformation caused by loop 100 being trapped between loop 102 and a cylindrical post.

In the practice of the present invention it is to be understood that it is preferable that link 38 be loosely secured to the mediate portion 30 of the first and second members 24 to permit limited movement of the post 40 within the recess 76 between the reliefs 74 of jaws 28. Referring now most particularly to FIG. 11, the jaws 28 preferably have a closing arc 106 and the limited movement of the post 40 is to be understood to be in a direction 108 generally perpendicular to the closing arc of the jaws 28. The post 40 is thus free to move towards and away form the connecting means 36 along the direction of arrow 108. The post 40 may also be free to move in other directions, as well, but the freedom of movement in the direction of arrow 108 will allow for formation of generally circular loops with various gauges of wire.

The method of forming a loop 80 in wire 70 according to the present invention includes forming a U-shape in a wire, placing the U-shape between the pair of jaws 28 in the pliers 22 which are of the type having opposing faces 72 on respective distal ends of the pair of jaws, with each jaw having a relief 74 between the face 72 and the pivot point 36 of the pliers 22. The reliefs 74 together form a recess 76, such that the U-shape may extend around the post 40 located in the recess 76. The method further includes closing the jaws 28 against the wire 70 such that the faces 72 compress the U-shape into a loop 80 surrounding the post 40. Finally, the method may include removing the wire loop 80 from the pliers 22. A further feature of the method includes carrying the post 40 by the link 38 loosely secured to the pivot point 36 of the pliers 22. In one aspect, the method may be carried out with pliers 22 having one or both opposing faces 72 being flat.

In a variation, the method of the present invention may include adjusting the stop 58 to limit the distance the faces 72 can approach each other. In another variation, the method may include using the through hole 66 in the pliers 22 to form the U-shape in the wire 70.

In another aspect, the method of the present invention includes deforming at least one of two portions of the wire 70 extending distally of the faces 72, more particularly deforming at least one portion of the wire around the other portion of the wire to form one or more coils or wraps 84 adjacent the loop 80.

This invention is not to be taken as limited to all of the details thereof as modifications and variations thereof may be made without departing from the spirit or scope of the invention.

What is claimed is:

1. A tool for forming wire, comprising:

a. a first member and a second member, each having a jaw and a handle and a mediate region between the jaw and handle;

b. a connecting means for securing the first and second members together at the mediate regions thereof and for permitting pivoting movement between the first and second members while locating the jaws on the same side of the connecting means such that the jaws are opposed to each other and free to move towards and away from each other; and c. a link attached solely to the mediate regions of the first and second members, and extending on the same side of the connecting means as the jaws, the link having a post projecting from the link and extending intermediate the jaws for forming wire around the post, wherein the post is free to move both radially towards and away from the connecting means to permit formation of generally circular loops with various gauges of wire.

2. The tool of claim 1 wherein the jaws each have a face at a distal end thereof and a relief intermediate the face and the mediate region, such that a recess is formed by the reliefs when the first and second members are assembled with the faces opposing each other, and with the post projecting into a recess formed by the reliefs of the jaws.

3. The tool of claim 1 wherein at least one face is flat.

4. The tool of claim 1 wherein each face is flat.

5. The tool of claim 2 wherein the link is loosely secured to the mediate regions of the first and second members to permit limited movement of the post within the recess.

6. The tool of claim 5 wherein the jaws have a closing arc and the limited movement of the post includes movement in other directions in addition to movement towards and away from the connecting means.

7. The tool of claim 1 further comprising an adjustable stop to limit the amount of pivoting movement of the jaws towards each other.

8. The tool of claim 1 further comprising a through hole in one of the first and second members for receiving a wire to make a prebend therein.

9. The tool of claim 1 wherein the connecting means includes i. a screw received in one of the first and second members, and ii. a threaded rivet received in the other of the first and second members, with the screw extending through aligned apertures in each of the first and second members and having a projection extending laterally from the mediate region sufficiently to receive the link.

10. The tool of claim 9 further comprising a threaded fastener received on the projection of the screw for retaining the link.

11. The tool of claim 10 wherein the threaded fastener is a locking nut.

12. The tool of claim 1 wherein the post includes a slot longitudinally oriented therein.

* * * * *